US008829374B2

(12) United States Patent
Uchida

(10) Patent No.: US 8,829,374 B2
(45) Date of Patent: Sep. 9, 2014

(54) APPARATUS

(75) Inventor: Tetsuo Uchida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 893 days.

(21) Appl. No.: 12/970,385

(22) Filed: Dec. 16, 2010

(65) Prior Publication Data

US 2011/0314951 A1 Dec. 29, 2011

(30) Foreign Application Priority Data

Jun. 25, 2010 (JP) ..... P2010-144756

(51) Int. Cl.
*H01H 9/00* (2006.01)
*G03G 15/00* (2006.01)

(52) U.S. Cl.
CPC ..... *G03G 15/5016* (2013.01); *G03G 15/80* (2013.01)
USPC ..... 200/294

(58) Field of Classification Search
USPC ..... 200/293, 294, 296, 297, 333
See application file for complete search history.

(56) References Cited

U.S. PATENT DOCUMENTS 4,560,972 A * 12/1985 Britt ..... 337/338
4,857,669 A * 8/1989 Kitamura et al. ..... 174/53
5,362,933 A * 11/1994 Kutsche et al. ..... 200/401
5,638,947 A * 6/1997 Fenne ..... 200/293
5,839,048 A 11/1998 Kato
6,423,916 B1 * 7/2002 Koebrick ..... 200/293
6,486,419 B2 * 11/2002 Horiguchi et al. ..... 200/43.19

FOREIGN PATENT DOCUMENTS

JP 58-117759 A 7/1983
JP 3-43788 U 4/1991
JP 8-99761 4/1996

OTHER PUBLICATIONS

Communication from the Japanese Patent Office dated Feb. 18, 2014, in a counterpart Japanese application No. 2010-144756.

* cited by examiner

*Primary Examiner* — Kyung Lee

(74) *Attorney, Agent, or Firm* — Sughrue Mion, PLLC

(57) ABSTRACT

An apparatus includes a switching member which is attached to a main unit of the apparatus; a fixing member which is placed to be movable in a direction along a surface of a supporting portion that is an attaching portion for the switching member, and that contacts with and supports the switching member, which is disposed separately from or integrally with the switching member, and which fixes the switching member; an opening/closing member which has an opening for operating the switching member, and which is openably and closably disposed with respect to the main unit to cover a periphery of the switching member; and a positioning member as defined herein.

16 Claims, 11 Drawing Sheets

APPARATUS

CROSS-REFERENCE TO RELATED APPLICATIONS

This application is based on and claims priority under 35 USC 119 from Japanese Patent Application No. 2010-144756 filed on Jun. 25, 2010.

BACKGROUND

1. Technical Field

The present invention relates to an apparatus.

2. Related Art

In an apparatus such as an image forming apparatus, conventionally, a power supply switch which turns ON or OFF the power supply of the apparatus is attached to the main unit side of the apparatus. In such an apparatus, there is a case where, in order to improve the operability, the appearance, and the like, the power supply switch is covered by an operation panel through which the user operates the apparatus, and an opening for operating the power supply switch is disposed in the operation panel. The operation panel is disposed integrally with an image reading apparatus or the like which is placed in an upper portion of the apparatus such as an image forming apparatus. In view of the maintainability and the like, the image reading apparatus is openably and closably attached to the apparatus main unit.

SUMMARY

According to an aspect of the invention, there is provided an apparatus including: a switching member which is attached to a main unit of the apparatus; a fixing member which is placed to be movable in a direction along a surface of a supporting portion that is an attaching portion for the switching member, and that contacts with and supports the switching member, which is disposed separately from or integrally with the switching member, and which fixes the switching member; an opening/closing member which has an opening for operating the switching member, and which is openably and closably disposed with respect to the apparatus main unit to cover a periphery of the switching member; and a positioning member which, when the opening/closing member is closed, performs positioning of the fixing member with respect to the opening of the opening/closing member, along a surface of the supporting portion for the switching member, by means of one positioning portion disposed on the fixing member, and another positioning portion disposed on the opening/closing member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to the drawings.

Exemplary Embodiment 1

Figure 2:
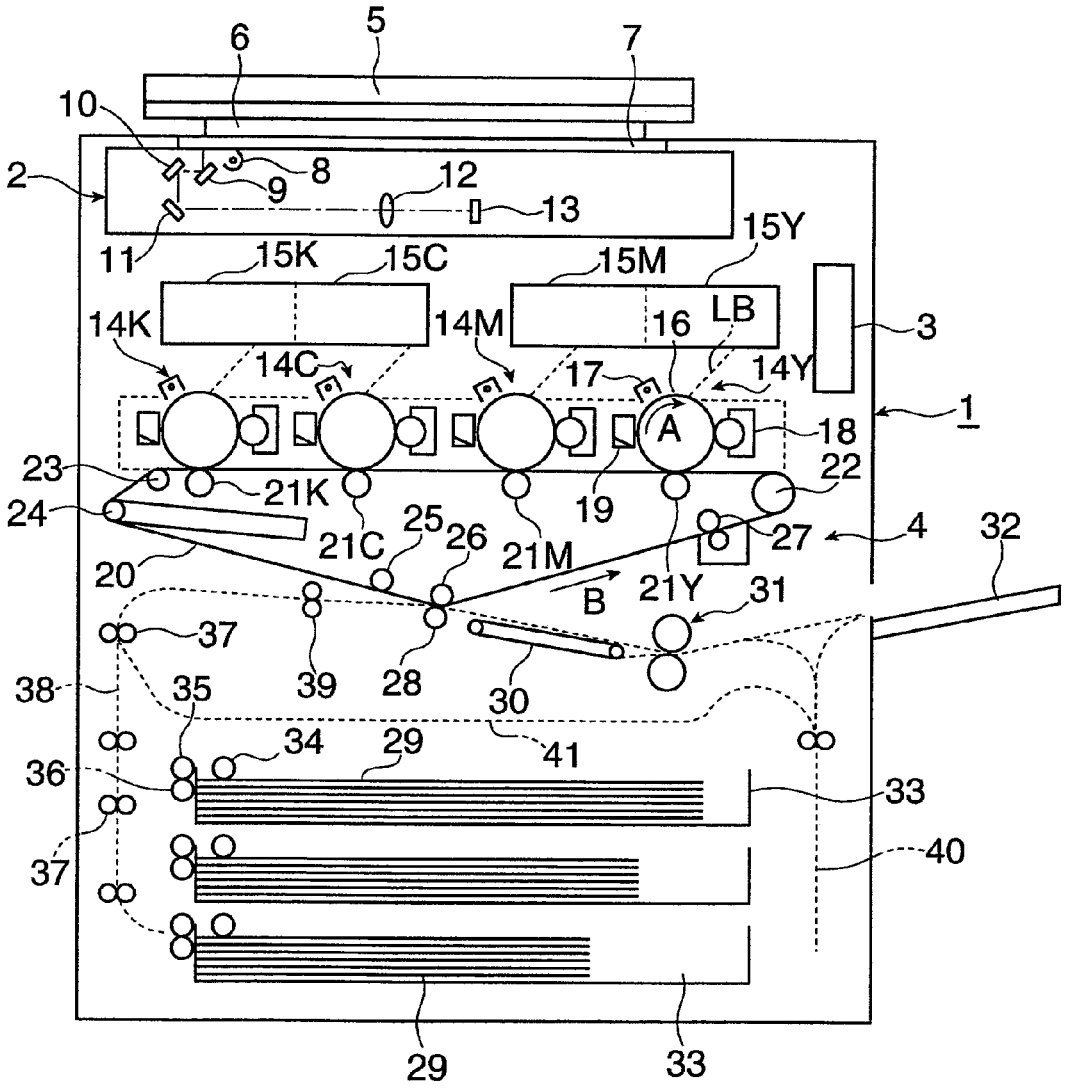
FIG. 2 is a diagram showing the image forming apparatus which is the apparatus of Exemplary embodiment 1 of the invention.

FIG. 2 is a diagram showing an electrophotographic image forming apparatus which is an apparatus of Exemplary embodiment 1 of the invention.

Referring to FIG. 2, 1 denotes the main unit of the image forming apparatus which is the apparatus main unit. An image reading apparatus 2 which reads an image of an original 6 is placed in an upper portion of the image forming apparatus main unit (hereinafter, often referred to merely as "apparatus main unit") 1. In the apparatus main unit 1, an image processing device 3 which applies predetermined image processes on image data that are supplied from the image reading apparatus 2, a personal computer (not shown), and the like, or those that are sent through a telephone line, a LAN, and the like is placed. Also an image outputting device 4 which outputs an image based on the image data that have undergone the predetermined image processing in the image processing device 3 is placed in the apparatus main unit 1.

The image reading apparatus 2 includes a platen glass 7 on which, when a document cover 5 is opened, an original 6 can be placed, and is configured so that the original 6 placed on the platen glass 7 is illuminated by a light source 8, the light image reflected from the original 6 scan-exposes an image reading element 13 configured by a CCD or the like through a reduction scanning optical system configured by a full-rate mirror 9, half-rate mirrors 10, 11, and an imaging lens 12, and the image of the original 6 is read by the image reading element 13.

The image of the original 6 read by the image reading apparatus 2 is sent in the form of (for example, 8-bit) reflectance data of three colors such as red (R), green (G), and blue (B), to the image processing device 3. In the image processing device 3, predetermined image processes such as shading correction, position deviation correction, brightness/color spatial conversion, gamma conversion, frame deletion, and color/movement edition are applied on the reflectance data of the original 6, and the data are converted to image data of four colors of yellow (Y), magenta (M), cyan (C), and black (K).

In the apparatus main unit 1, four image forming units 14Y, 14M, 14C, 14K for yellow (Y), magenta (M), cyan (C), and black (K) are horizontally arranged in a parallel manner while forming constant intervals therebetween.

As shown in FIG. 2, basically, the four image forming units 14Y, 14M, 14C, 14K are configured in the same manner except the color of an image to be formed. Roughly, each of the image forming units is configured by: a photosensitive drum 16 functioning as an image carrier which is rotated in the direction of arrow A at a predetermined speed; a scorotron 17 for primary charging which uniformly charges the surface of the photosensitive drum 16; an image exposing device 15 which applies image exposure to the surface of the photosensitive drum 16 on the basis of image data corresponding to the each color to form an electrostatic latent image; a developing device 18 which develops the electrostatic latent image formed on the photosensitive drum 16 by a toner of the corresponding color; and a cleaning device 19 which removes a toner and like residuals remaining on the surface of the photosensitive drum 16.

As shown in FIG. 2, the image processing device 3 sequentially supplies image data of the respective colors to the image exposing devices 15Y, 15M, 15C, 15K of the image forming units 14Y, 14M, 14C, 14K for yellow (Y), magenta (M), cyan (C), and black (K), and the laser beams LB which are emitted from the image exposing devices 15Y, 15M, 15C, 15K in accordance with the image data scan-expose the surfaces of the corresponding photosensitive drums 16Y, 16M, 16C, 16K to form electrostatic latent images. The electrostatic latent images formed on the surfaces of the corresponding photosensitive drums 16Y, 16M, 16C, 16K are developed by the developing devices 18Y, 18M, 18C, 18K, as color toner images of yellow (Y), magenta (M), cyan (C), and black (K), respectively.

The color toner images of yellow (Y), magenta (M), cyan (C), and black (K) which are sequentially formed on the photosensitive drums 16Y, 16M, 16C, 16K of the image forming units 14Y, 14M, 14C, 14K are multiply transferred by primary transfer rolls 21Y, 21M, 21C, 21K onto an intermediate transfer belt 20 functioning as an endless belt-like intermediate transfer member which is placed below the image forming units 14Y, 14M, 14C, 14K, at respective primary transfer positions as shown in FIG. 2. The intermediate transfer belt 20 is wound at a constant tension around a driving roll 22, a driven roll 23, a tensioning roll 24, a driven roll 25, a back-up roll 26, and a driven roll 27, and circularly driven at a predetermined moving speed in the direction of arrow B by the driving roll 22 which is rotatingly driven by a dedicated driving motor that has an excellent constant speed property, and that is not shown. An endless belt-like member produced by forming a film of a flexible synthetic resin such as polyimide or polyamide-imide into a belt-like shape may be used as the intermediate transfer belt 20.

The color toner images of yellow (Y), magenta (M), cyan (C), and black (K) which are multiply transferred onto the intermediate transfer belt 20 are collectively secondary-transferred at a secondary transfer position onto a recording sheet 29 functioning as a recording medium, by a secondary transfer roll 28. The recording sheet 29 onto which toner images corresponding to colors of images to be formed are transferred is conveyed to a fixing device 31 by a conveyor belt 30. The recording sheet 29 onto which the color toner images are transferred undergoes a fixing process by means of heat and pressure in the fixing device 31, and then discharged onto a discharge tray 32 disposed outside the apparatus main unit 1.

As shown in FIG. 2, as the recording sheet 29, a sheet of the desired size and quality is fed from a plurality of sheet feed trays 33 disposed in a lower portion of the apparatus main unit 1, in a one-by-one separated manner by a sheet feeding roll 34 and a pair of sheet separation rolls 35, 36, and once conveyed to a registration roll 39 through a sheet conveying path 38 in which a plurality of conveying rolls 37 are disposed. The recording sheet 29 which is fed from one of the sheet feed trays 33 is sent to the secondary transfer position of the intermediate transfer belt 20 by the registration roll 39 which is rotatingly driven at a predetermined timing.

The image forming apparatus is configured so that, in the case where images are to be formed on both faces of the recording sheet 29, the recording sheet 29 in which an image is formed on one face is not directly discharged onto the discharge tray 32, but the conveying path for the recording sheet 29 which has been passed through the fixing device 31 is switched to a reversing sheet conveying path 40 which is positioned in the lower side, and then the sheet is again conveyed to the secondary transfer position of the intermediate transfer belt 20 in a reversed state while being passed through a both-face sheet conveying path 41, thereby forming an image on the rear face of the recording sheet 29.

Figure 3:
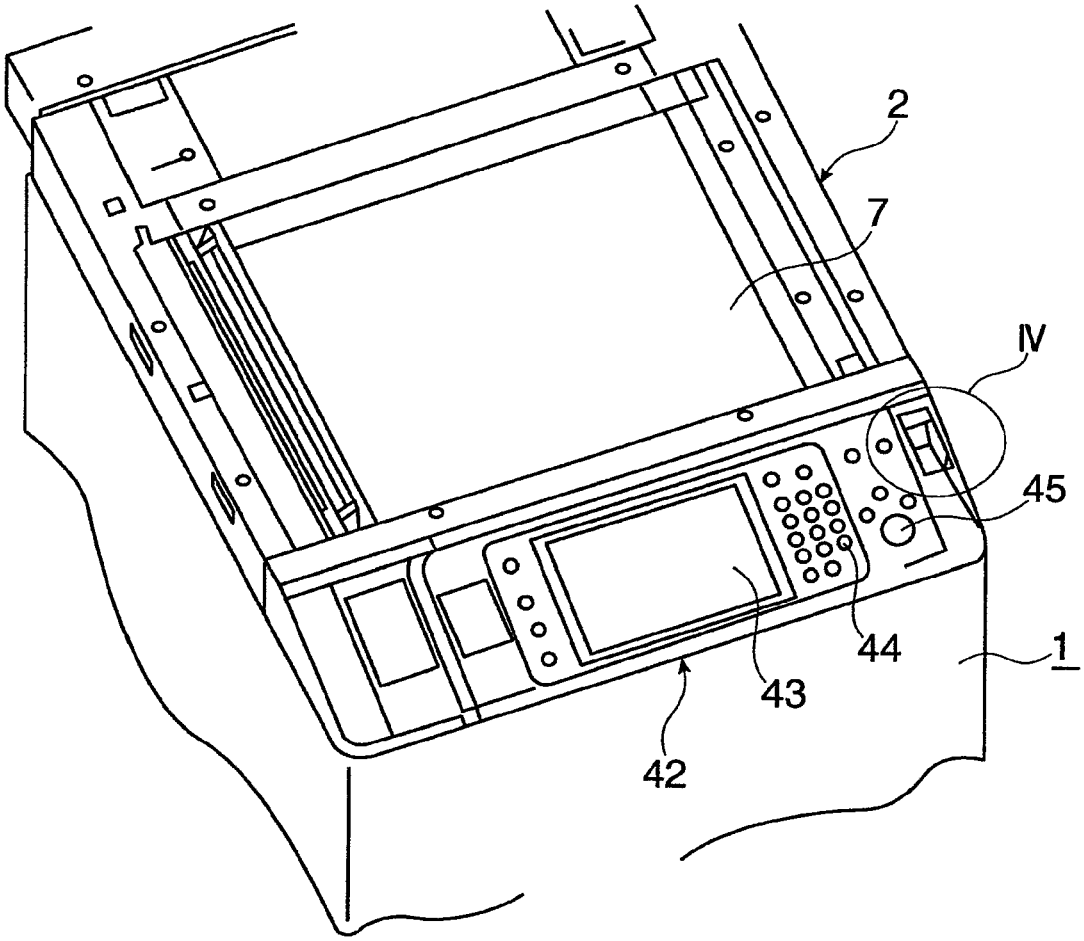
FIG. 3 is a perspective view showing main portions of the image forming apparatus which is the apparatus of Exemplary embodiment 1 of the invention.

In the image forming apparatus, as shown in FIG. 3, an operation panel 42 functioning as a user interface portion which allows the user to operate the image forming apparatus is placed in the front side of the image reading apparatus 2. The operation panel 42 is attached in a fixed state to the image reading apparatus 2. The operation panel 42 includes a touch sensitive liquid crystal display panel 43 through which the user can set the size and kind of the recording sheet 29, or image formation conditions such as the number of sheets on which an image is to be formed, and the image forming mode. A numeric keypad 44 for inputting a number, a start button 45, and the like are placed in the periphery of the liquid crystal display panel 43.

Figure 5:
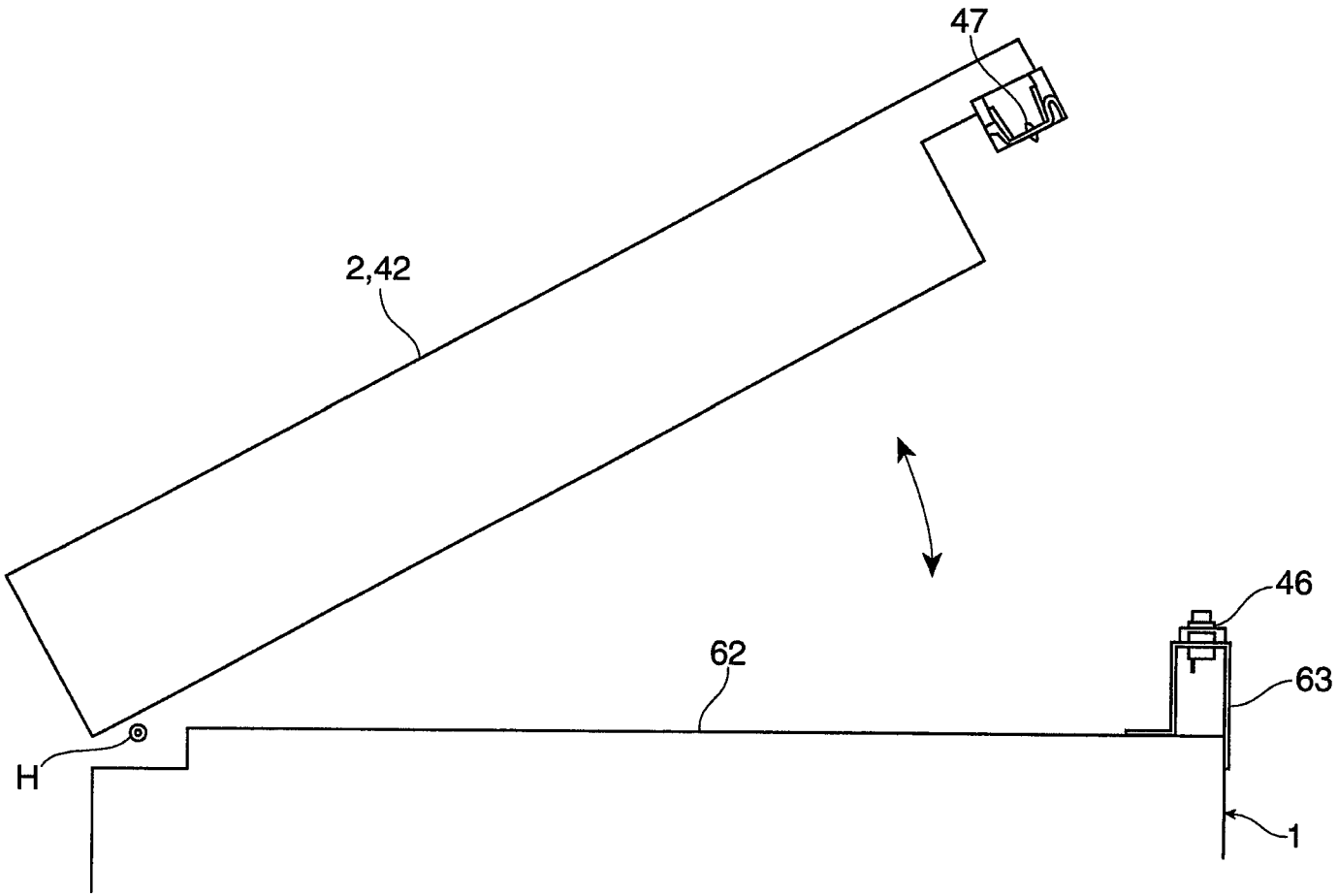
FIG. 5 is a diagram showing an opening/closing mechanism of an image reading apparatus.

As shown in FIG. 5, the image reading apparatus 2 is openably and closably attached to the apparatus main unit 1 through a hinge portion H. In the case where, for example, the image exposing devices 15Y, 15M, 15C, 15K of the image forming units 14Y, 14M, 14C, 14K are to be subjected to maintenance, the image reading apparatus can be opened by removing attaching screws which are not shown, and rotating the apparatus about the hinge H in a counterclockwise direction in FIG. 5. Because of wirings such as a harness of the image reading apparatus 2 which may be used in common with another image forming apparatus, the hinge portion H which openably and closably supports the image reading apparatus 2 is disposed in a left end portion of the apparatus main unit 1, and the image reading apparatus 2 is attached so as to be rotated in a counterclockwise direction in FIG. 5.

Figure 4:
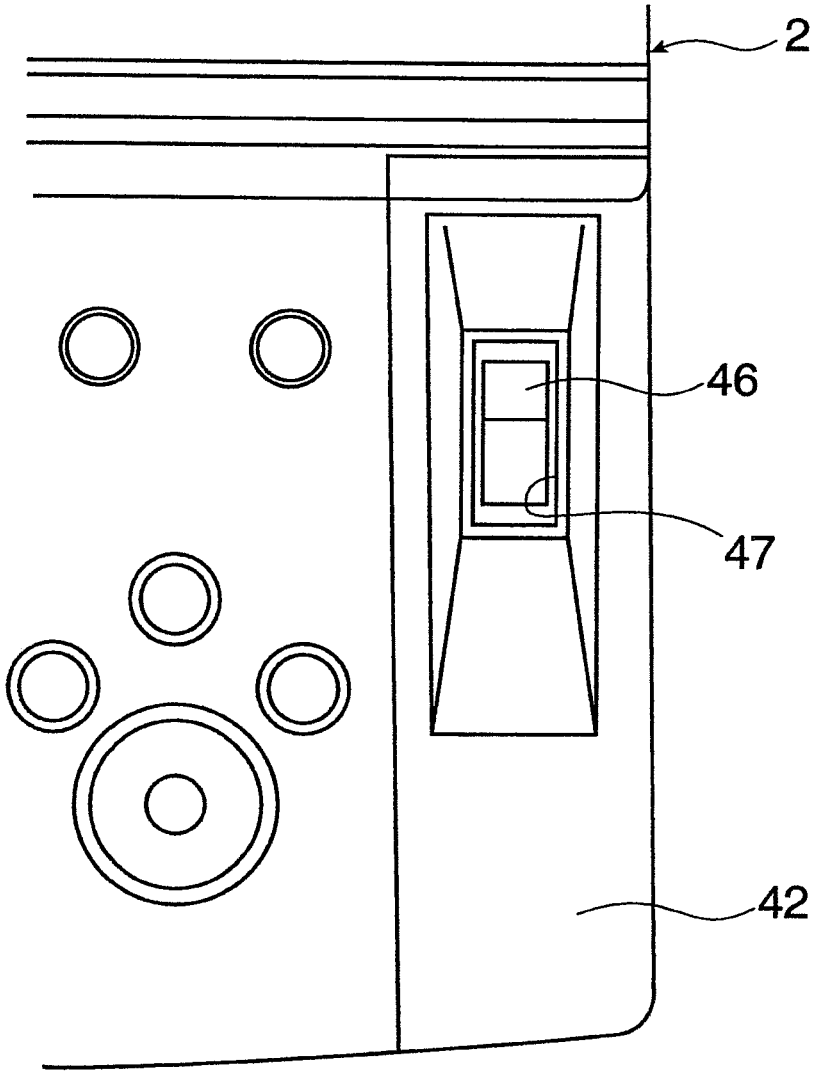
FIG. 4 is a plan view showing an operation panel.

In the operation panel 42, as shown in FIG. 4, a power supply switch 46 functioning as a switching unit for turning ON/OFF the main power supply of the image forming apparatus is placed in a right end portion of the operation panel 42 in view of the operability and the like. As shown in FIG. 5, the power supply switch 46 is attached not to the operation panel 42 but to the apparatus main unit 1 which is covered by the operation panel 42, and an opening 47 for operating the power supply switch 46 is disposed in the operation panel 2.

Figure 6:
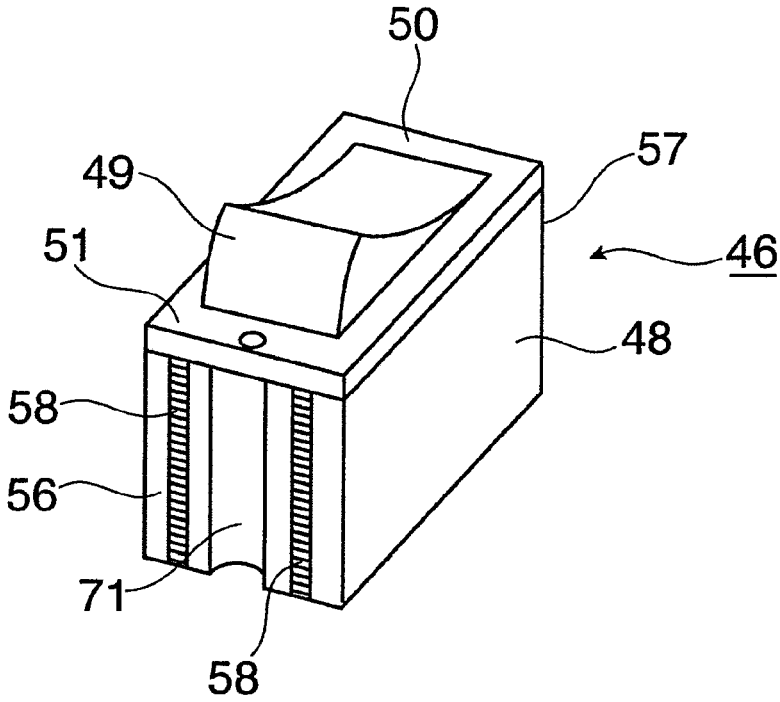
FIG. 6 is a perspective view showing a power supply switch.

As shown in FIG. 6, the power supply switch 46 is roughly configured by: the switch body 48 which is formed into a substantially rectangular parallelepiped shape; and an operating portion 49 which is disposed to be projected from the upper end face of the switch body 48, and which is switched between an ON position and an OFF position. When the user operates by means of a finger the operating portion 49 of the power supply switch 46, the operating portion is moved to a state in which the portion is inclined to an OFF position 50 where the main power supply of the image forming apparatus is in the cutoff state, or to that in which the portion is inclined to an ON position 51 where the main power supply is in the conduction state, thereby turning ON/OFF the main power supply of the image forming apparatus.

The power supply switch 46 is not limited to a switch which directly turns ON/OFF a commercial power source of, for example, 100 V to be supplied to the image forming apparatus. Of course, the power supply switch may be a switch which turns ON/OFF a signal for operating a power supply circuit that turns ON/OFF a commercial power source of 100 V disposed in a control box (not shown). The switching member is not limited to the power supply switch 46, and may be another switch as far as the switch can be attached to the main unit of an apparatus such as an image forming apparatus.

Figure 7:
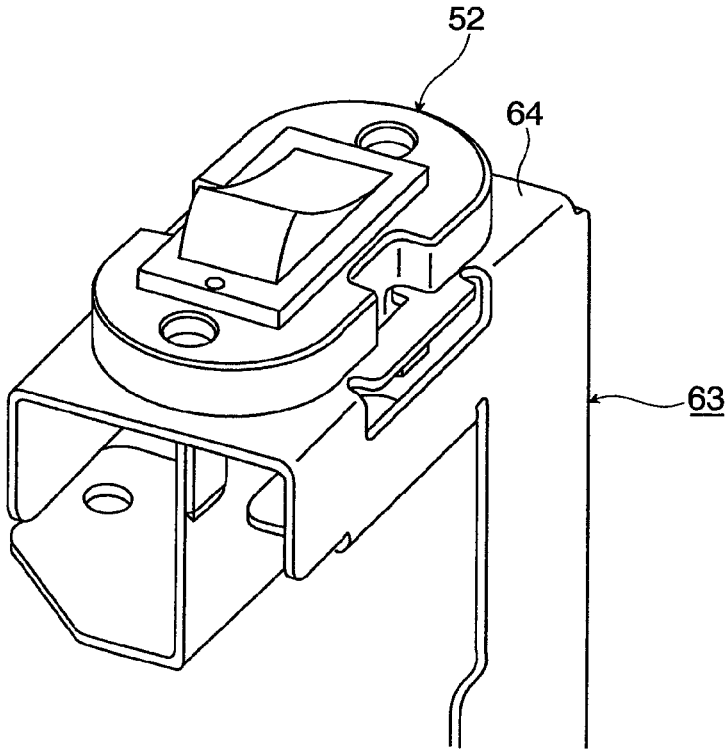
FIG. 7 is a perspective view showing an attaching portion for the switch.
Figure 8A:
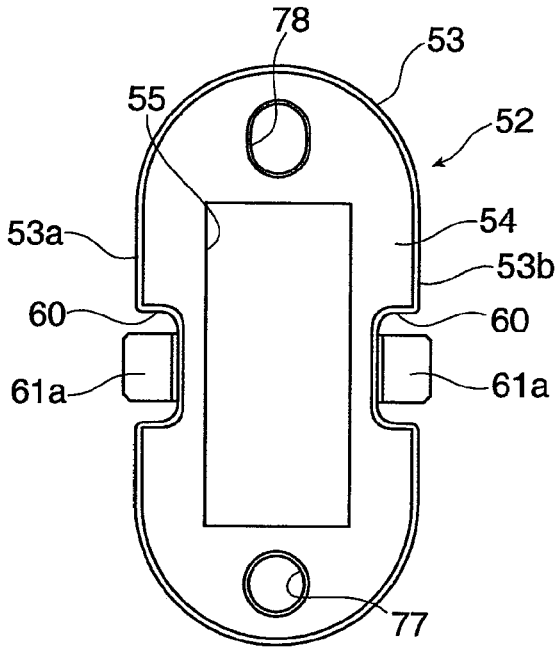
FIGS. 8A, 8B and 8C are views showing a switch fixing member.
Figure 8B:
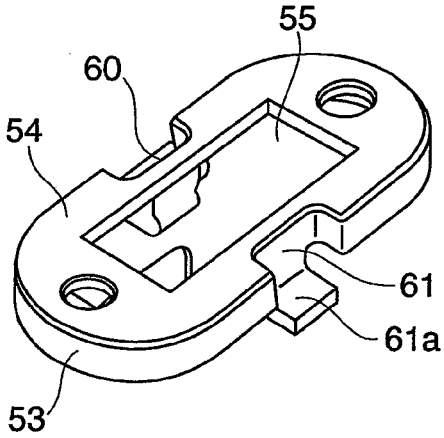
Figure 8C:
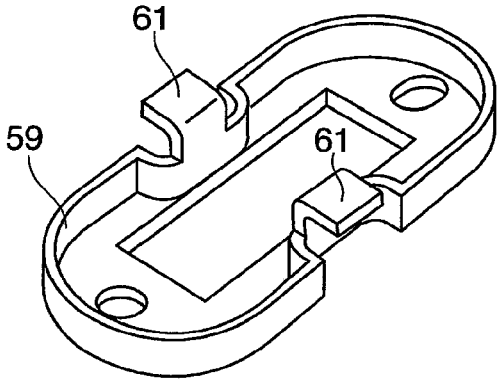

As shown in FIG. 7, the power supply switch 46 is attached in a state where the switch is fixed to a switch fixing member 52 functioning as a fixing member. As shown in FIGS. 8A to 8C, the switch fixing member 52 is configured by a molded product made of a synthetic resin so that an outer peripheral wall 53 which is positioned at the outer circumference has a predetermined height, and an upper end portion 54 is formed into a planar shape which is substantially ellipsoidal in a plan view, and, in a middle area, includes a fixing opening 55 which is used for fixing the power supply switch 46 in a fitted state, and which is rectangular in a plan view. The fixing opening 55 is set to be slightly larger than the plan shape of the switch body 48 of the power supply switch 46, so that, when the switch body 48 of the power supply switch 46 is fitted into the fixing opening 55, the power supply switch 46 is held in a fixed state.

In the power supply switch 46, as shown in FIG. 6, as required, snap-fit portions 58 are disposed on the two side faces 56, 57 in the longitudinal direction of the switch body 48. Pluralities of minute convexes and concaves which are formed in the surfaces of the snap-fit portions 58 pressingly contact with the inner face of the fixing opening 55, thereby allowing the switch body 48 of the power supply switch 46 to be surely fixed to the fixing opening 55 of the fixing member 52.

As shown in FIG. 8C, the lower end face 59 of the outer peripheral wall 53 which is formed in the outer circumference of the fixing member 52, and which is ellipsoidal in a plan view is formed. The fixing member 52 is supported in a state where the lower end face 59 contacts with the surface of an attaching portion to which the power supply switch 46 is attached, and which will be described later, and is placed so as to be movable in a direction along the surface of the supporting portion.

In the switch fixing member 52, recesses 60, 60 which are inwardly concaved are disposed respectively in middle portions in the longitudinal direction of outer peripheral walls 53*a*, 53*b* that are positioned in both end portions in the short direction perpendicular to the longitudinal direction of the switch fixing member. In each of the recesses 60, a slipping-off preventing portion 61 in which a lower end portion 61*a* is formed with being outward bent in an L-like shape is disposed integrally with the inner end. The slipping-off preventing portions 61 of the switch fixing member 52 prevent the fixing member 52 from slipping off from the attaching portion for the power supply switch 46, by, in a state where the fixing member 52 is placed in the attaching portion for the power supply switch 46, causing the lower end portions 61*a* which are bent in an L-like shape, to butt against the end edge of an opening that is disposed in the attaching portion for the power supply switch 46 as described later.

In the attaching portion to which the power supply switch 46 is attached, as shown in FIG. 5, a bracket 63 which is attached onto a main frame 62 of the apparatus main unit 1 is disposed. The upper end face (the surface of the supporting portion) 64 of the bracket 63 is configured as the attaching portion to which the power supply switch 46 is attached. It is a matter of course that the attaching portion for for the power supply switch 46 may be configured by the main frame 62 itself in place of the bracket 63 attached to the main frame 62.

Figure 1:
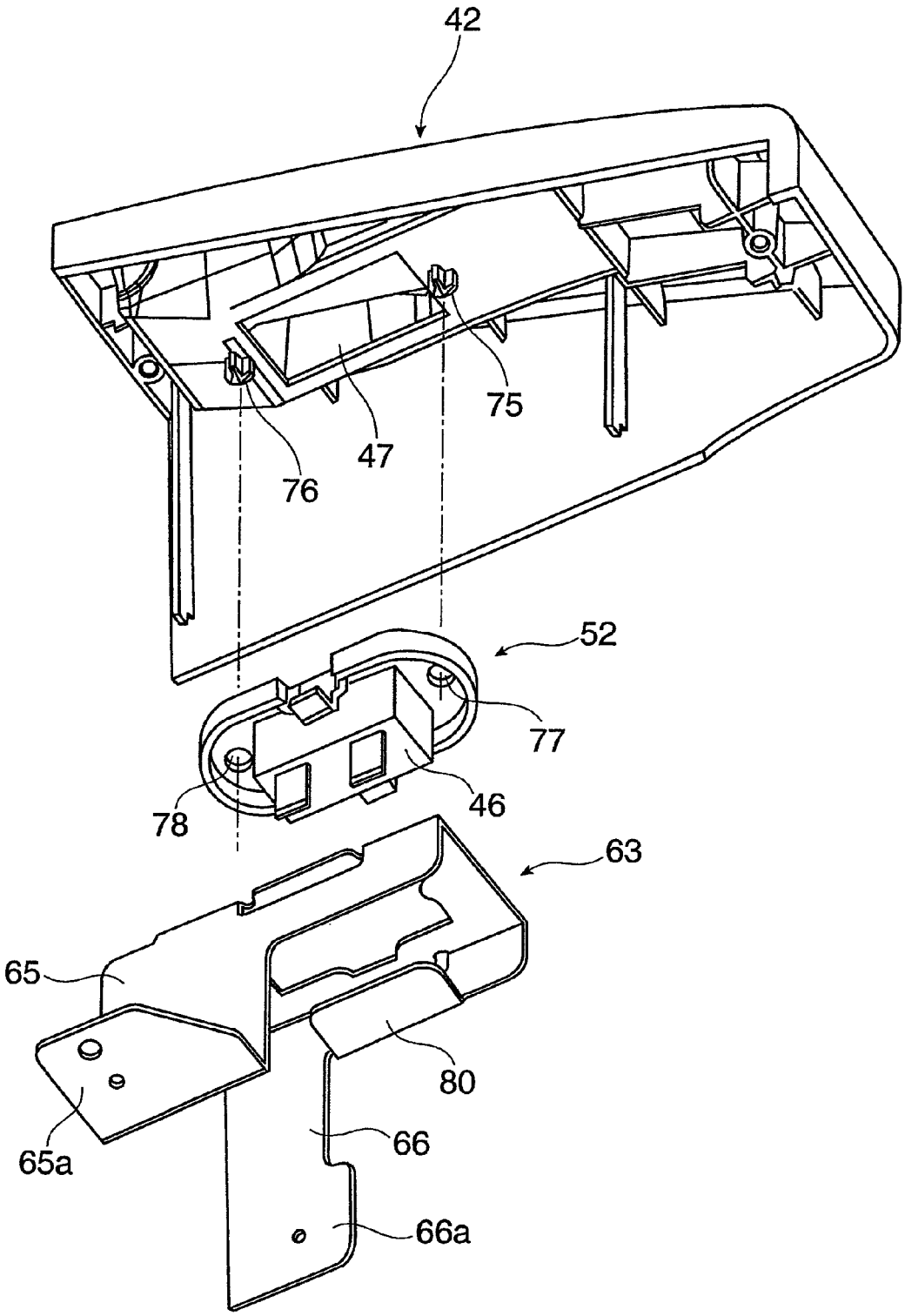
FIG. 1 is an exploded perspective view showing main portions of an image forming apparatus which is an apparatus of Exemplary embodiment 1 of the invention.
Figure 9:
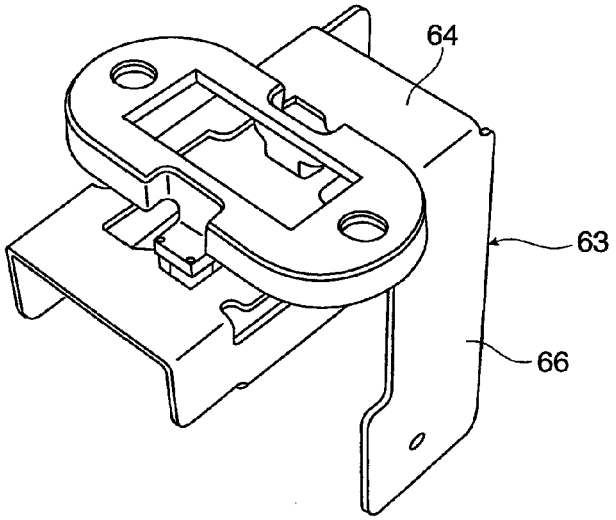
FIG. 9 is a perspective view showing a state where the switch fixing member is attached.

As shown in FIG. 1, the bracket 63 is formed by, for example, applying a bending process on a sheet metal, and, as shown in FIG. 5, fixed to the main frame 62 of the apparatus main unit 1 by means of screwing or the like. In the bracket 63, as shown in FIGS. 1 and 9, the upper end face 64 is formed into a rectangular shape in a plan view, and a pair of leg portions 65, 66 which are formed respectively by bending the both end portions in the short direction of the upper end face 64 toward the rear face side are disposed in one end portion in the longitudinal direction of the upper end face 64. In the one leg portion 65, a lower end portion 65*a* is outward bent into an L-like shape. By contrast, the other leg portion 66 is formed into a planar shape extending to a lower end portion 66*a*.

Figure 10:
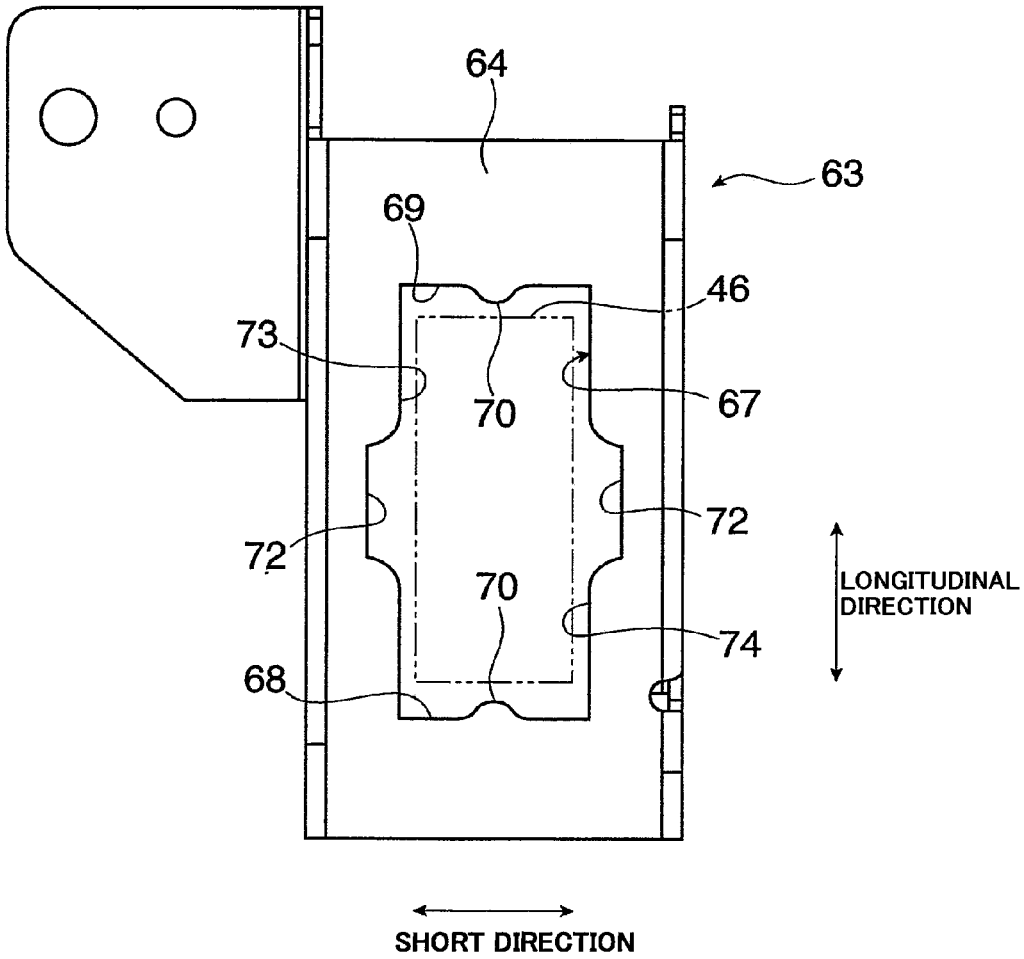
FIG. 10 is a plan view showing a bracket.

In the upper end face 64 of the bracket 63, as shown in FIG. 10, an opening 67 for allowing the power supply switch 46 to be movably attached is disposed in a substantially rectangular shape which is larger than the plan shape of the power supply switch 46. In the opening 67, projections 70 which restrict the movement range of the power supply switch 46, and which have a substantially semicircular shape are disposed so as to be inward projected in the both end edges 68, 69. As shown in FIG. 6, the projections 70 contact with grooves 71 which are disposed in the two side faces 56, 57 in the longitudinal direction of the switch body 48, thereby restricting the movement range in the short direction perpendicular to the longitudinal direction of the power supply switch 46.

Figure 11:
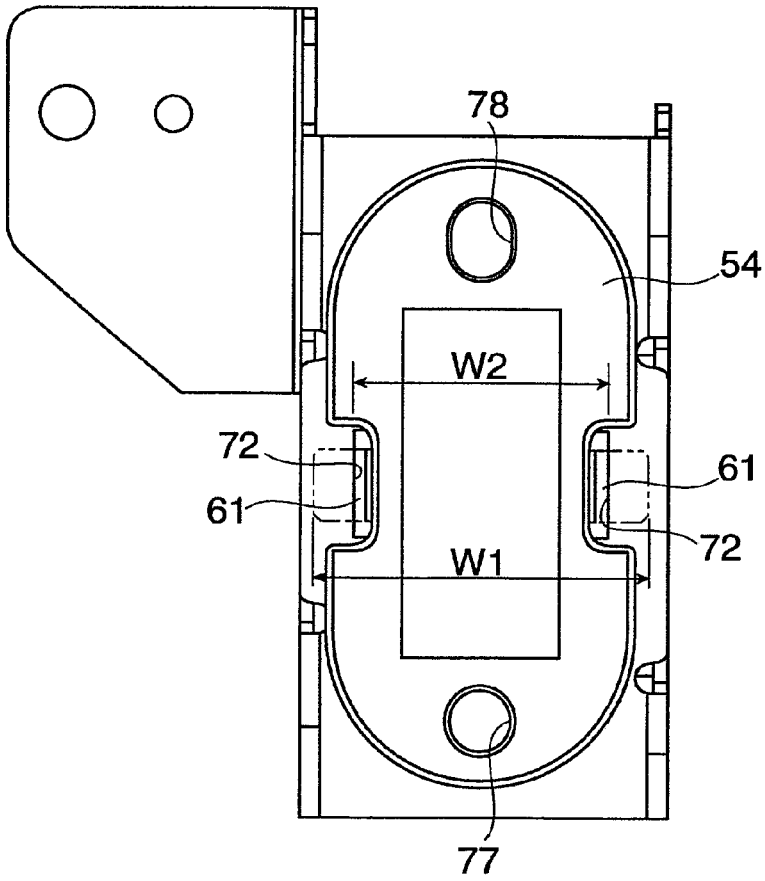
FIG. 11 is a plan view showing a state where the switch fixing member is attached to the bracket.

In the opening 67 of the bracket 63, as shown in FIG. 10, grooves 72, 72 functioning as a second restricting portion for restricting the movement range of the power supply switch 46 in the longitudinal direction of the opening 67 are disposed. The grooves 72, 72 are disposed in a predetermined length in middle portions in the longitudinal direction of the both end edges 73, 74 in the short direction perpendicular to the longitudinal direction of the opening 67. As shown in FIG. 11, the grooves 72, 72 contact with the slipping-off preventing portions 61 disposed in the fixing member 52, thereby restricting the range in which the power supply switch 46 fixed to the fixing member 52 is moved in the longitudinal direction of the opening 67.

Figure 12:
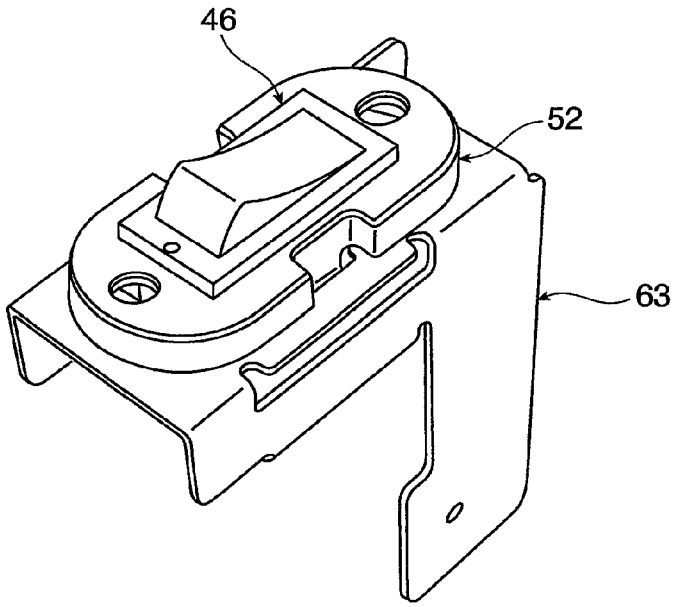
FIG. 12 is a perspective view showing the attaching portion for the switch.

As shown in FIGS. 11 and 12, the grooves 72, 72 disposed in the opening 67 of the bracket 63 contact with the slipping-off preventing portions 61 of the fixing member 52 to prevent the power supply switch 46 fixed to the fixing member 52 from slipping off from the bracket 63.

As shown in FIG. 11, the projection width W1 of the slipping-off preventing portions 61 of the switch fixing member 52 is set to be larger than the opening width W2 of the grooves 72, 72 disposed in the opening 67 of the bracket 63. When the switch fixing member 52 to which the power supply switch 46 is fixed is tried to be lifted up, the tip end portion 61*a* of the slipping-off preventing portion 61 of the switch fixing member 52 butts against the end edge of the opening 67 of the bracket 63, whereby the power supply switch 46 fixed to the fixing member 52 is prevented from slipping off from the bracket 63.

Figure 13:
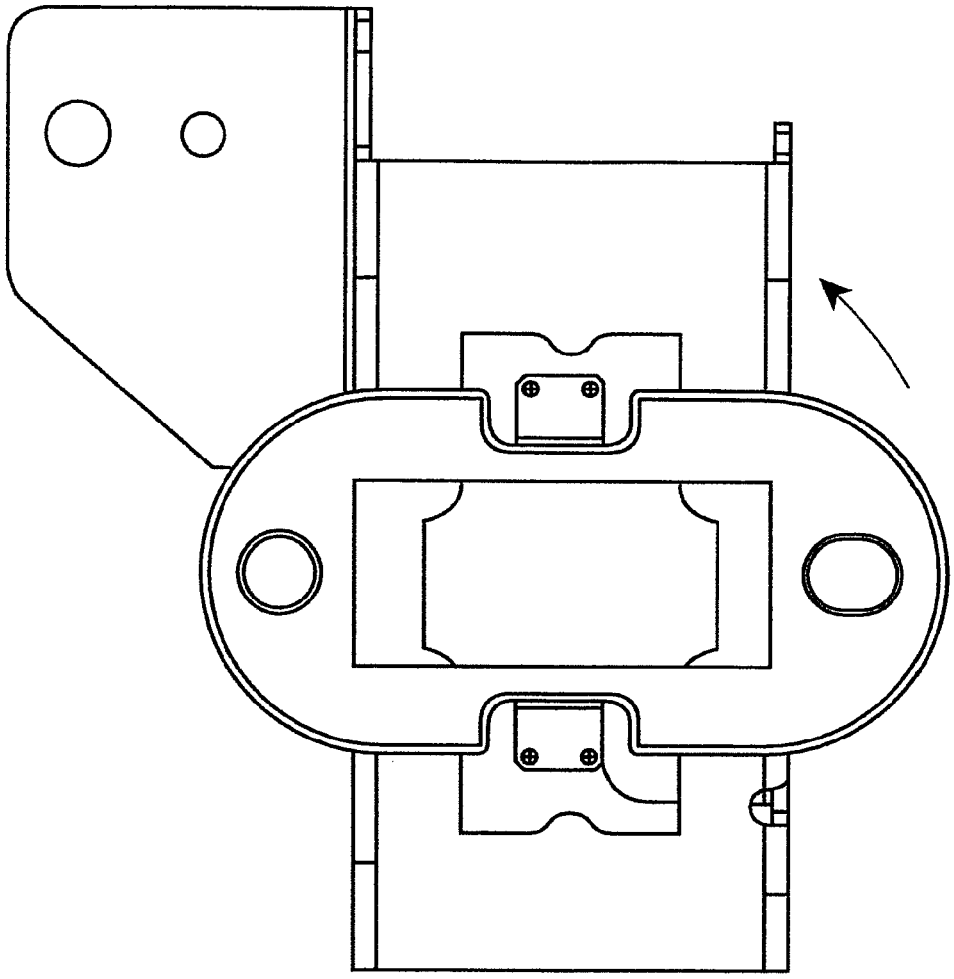
FIG. 13 is a plan view showing the state where the switch fixing member is attached.

When the switch fixing member 52 is to be attached to the opening 67 of the bracket 63, therefore, the slipping-off preventing portion 61 of the switch fixing member 52 is inserted into the opening 67 of the bracket 63 in a state where the switch fixing member 52 is rotated by about 90 degrees with respect to the opening 67 of the bracket 63 as shown in FIG. 13, and then the switch fixing member 52 is again rotated by about 90 degrees in a counterclockwise direction as shown in FIG. 11, so that the switch fixing member 52 is attached to an adequate position of the opening 67 of the bracket 63.

In the switch fixing member 52, as shown in FIGS. 1 and 11, positioning holes 77, 78 are disposed in the upper end portion 54. The positioning holes 77, 78 function as other positioning portions into which positioning projections 75, 76 functioning as one positioning portions that are downward projected from the rear face of the operation panel 42 are to inserted. As shown in FIG. 11, the positioning holes 77, 78 are formed in the vicinities of both end portions in the longitudinal direction of the upper end face of the switch fixing member 52. The one positioning hole 78 is an oblong hole which is larger than the other positioning hole 77.

Figure 14:
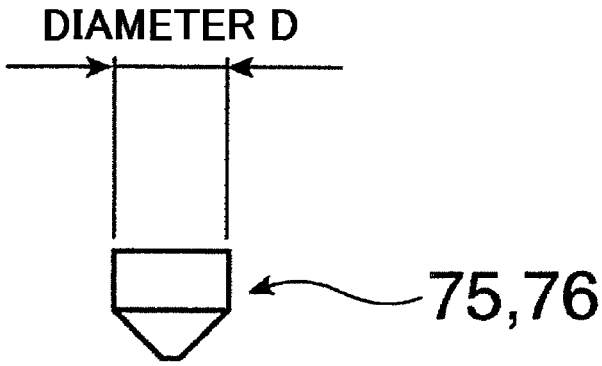
FIG. 14 is a front view showing a positioning projection.

In the positioning projections 75, 76 disposed on the rear face side of the operation panel 42, as shown in FIG. 14, basal end portions are formed into a columnar shape having a diameter D, and tip end portions are formed into a conical shape, so that, even in the case where the positioning holes 77, 78 of the switch fixing member 52 are positionally misaligned with each other by about D/2, the positioning projections 75, 76 of the operation panel 42 can be relatively positioned with respect to the positioning holes 77, 78 of the switch fixing member 52.

In FIG. 1, 80 denotes a drop preventing piece which prevents the power supply switch 46 from erroneously dropping off from the bracket 63.

In the thus configured image forming apparatus of the exemplary embodiment, even in the case where cumulative tolerances exist between the switch operation opening of the opening/closing member that is openably and closably disposed in the apparatus main unit, and the switching member that is attached to the apparatus main unit, positional misalignment can be suppressed from occurring between the opening of the opening/closing member and the switching member.

Namely, in the image forming apparatus of the exemplary embodiment, as shown in FIG. 1, the power supply switch 46 is attached in the state where the switch is fixed to the switch fixing member 52, and the switch fixing member 52 is attached to the upper end face 64 of the bracket 63 to which the power supply switch 46 is attached, so as to be movable in the direction along the surface of the upper end face 64 of the bracket 63.

As shown in FIG. 3, the operation panel 42 which is openably and closably attached so as to cover the power supply switch 46 is attached to the image reading device 2, and the image reading apparatus 2 can be opened in a counterclockwise direction in FIG. 5 using the hinge portion H as a fulcrum with respect to the apparatus main unit 1. In the case where, for example, the image exposing devices 15Y, 15M, 15C, 15K of the image forming apparatus are to be subjected to maintenance, therefore, the operation panel is opened together with the image reading apparatus 2 with respect to the apparatus main unit 1. As shown in FIG. 5, furthermore, the operation panel 42 is openably and closably attached through the hinge portion H which is disposed in the left end portion of the apparatus main unit 1, and by contrast the power supply switch 46 is attached to the right end portion of the apparatus main unit 1 which is opposite to the hinge portion H. These two components are placed while being separated from each other.

The operation panel 42 which covers the power supply switch 46 is moved to the opened state as shown in FIG. 5, and a state where the power supply switch 46 and the switch fixing member 52 are exposed to the outside is attained. In this case, even when the service engineer erroneously contacts with the power supply switch 46 or the switch fixing member 52, the power supply switch 46 and the switch fixing member 52 can be prevented from dropping off, because the switch fixing member 52 to which the power supply switch 46 is attached is in the state where the fixing member is prevented from slipping-off from the bracket 63.

The the movement range of the switch fixing member 52 with respect to the bracket 63 is restricted, and hence the switch fixing member 52 is not largely deviated from a predetermined range.

Next, when the service engineer ends the process of maintaining or repairing the image exposing devices or the like, the image reading apparatus 2 is rotated in a clockwise direction to be closed as shown in FIG. 5, and then fixed by the attaching screws (not shown) or the like to a predetermined position of the apparatus main unit 1.

In this case, when the image reading apparatus 2 is closed, also the operation panel 42 attached to the image reading apparatus 2 is closed with respect to the apparatus main unit 1, and fixed to a predetermined position.

Figure 15A:
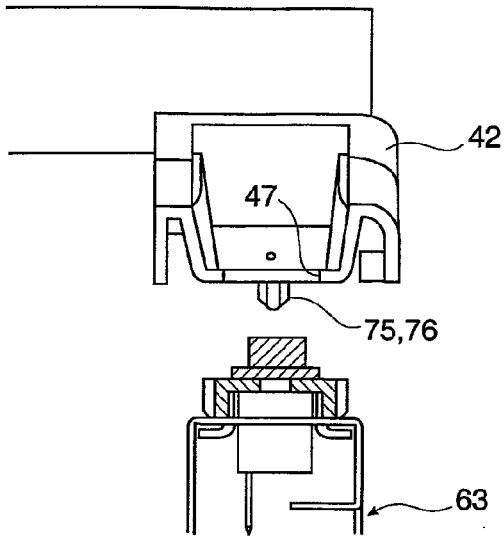
FIGS. 15A, 15B and 15C are sectional configuration views showing a state where the operation panel is closed.
Figure 15B:
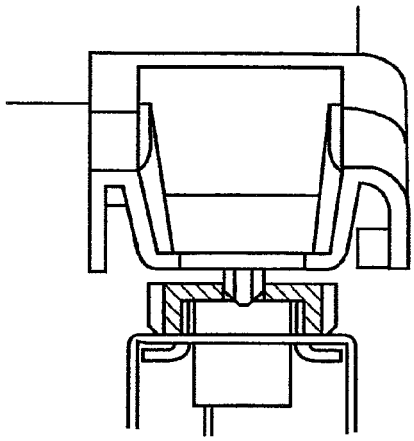
Figure 15C:
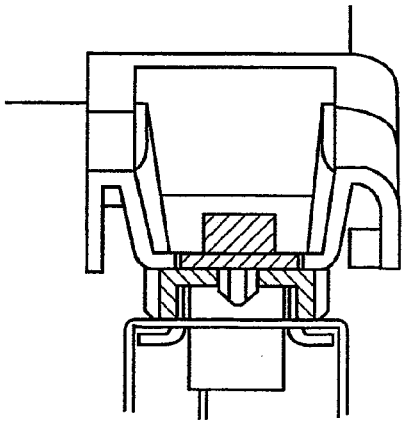

When the operation panel 42 is closed as described above, the pointed tip end portions of the positioning projections 75, 76 disposed on the rear face side of the operation panel 42 contact with the positioning holes 77, 78 of the switch fixing member 52 as shown in FIG. 15. Even in the case where positional misalignment due to cumulative tolerances or the like exists between the opening 47 of the operation panel 42 and the switch fixing member 52 to which the power supply switch 46 is fixed, the switch fixing member 52 is moved in accordance with the lowering of the positioning projections 75, 76 of the operation panel 42 so that the positioning projections 75, 76 of the operation panel 42 are positioned at substantially centers of the positioning holes 77, 78 of the switch fixing member 52, because the switch fixing member 52 is movable with respect to the bracket 63. Therefore, the positioning projections 75, 76 of the operation panel 42 are fitted into the positioning holes 77, 78 of the switch fixing member, respectively. As a result, the process of positioning the opening 47 of the operation panel 42 and the power supply switch 46 is completed.

Therefore, the opening 47 of the operation panel 42 and the power supply switch 46 can be easily positioned only by operations of opening and closing the operation panel 42, thereby avoiding situations where the relative positional relationship between the opening 47 of the operation panel 42 and the power supply switch 46 is shifted, and, when the operation panel 42 is closed, the opening 47 of the operation panel 42 interferes with the power supply switch 46, the operability of the power supply switch 46 is lowered, and where the positional relationship between the opening 47 of the operation panel 42 and the power supply switch 46 is shifted, and the appearance is impaired.

As a result, when the operation panel 42 is to be closed, it is not required to perform the work of again adjusting the position of the power supply switch 46 with respect to the opening 47 of the operation panel 42, and hence the operability can be improved.

Although the exemplary embodiment in which the invention is applied to the image forming apparatus serving as the apparatus has been described, it is a matter of course that the invention can be applied not only to an image forming apparatus but also to other apparatuses such as an image reading apparatus as far as a switching member is attached to the side of the main unit of the apparatus, an opening/closing member that is openably and closably disposed in the apparatus main unit is placed so as to cover the switching member, and the opening/closing member has an opening through which the switching member is operated.

Although the exemplary embodiment in which the positioning projections are disposed as a positioning portion on the side of the operation panel, and the positioning holes are disposed as a positioning portion on the side of the fixing member has been described, it is a matter of course that the positioning holes may be disposed on the side of the operation panel, and the positioning projections may be disposed on the side of the fixing member.

Although the exemplary embodiment in which the fixing member is disposed separately from the switching member has been described, the fixing member and the switching member may be configured so as to be integrated with each other. In this case, the configuration can be further simplified.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An apparatus comprising:

a switching member which is attached to a main unit of the apparatus;

a fixing member which is placed to be movable in a direction along a surface of a supporting portion that is an attaching portion for the switching member, and that contacts with and supports the switching member, which is disposed separately from or integrally with the switching member, and which fixes the switching member;

an opening/closing member which has an opening for operating the switching member, and which is openably and closably disposed with respect to the main unit to cover a periphery of the switching member; and a positioning member which, when the opening/closing member is closed, performs positioning of the fixing member with respect to the opening of the opening/closing member, along a surface of the supporting portion for the switching member, by means of one positioning portion disposed on the fixing member and another positioning portion disposed on the opening/closing member.

2. The apparatus according to claim 1, wherein the fixing member comprises a restricting portion which restricts movement in a direction perpendicular to a direction along the surface of the supporting portion for the switching member.

3. The apparatus according to claim 1, wherein the switching member is placed in an end portion of the opening/closing member, the end portion being positioned oppositely to the supporting portion which support the opening/closing member openably and closably with respect to the apparatus.

4. The apparatus according to claim 2, wherein the switching member is placed in an end portion of the opening/closing member, the end portion being positioned oppositely to the supporting portion which support the opening/closing member openably and closably with respect to the apparatus.

5. The apparatus according to claim 1, wherein the fixing member is allowed by a gap formed between an outer circumference of the switching member fixed to the fixing member, and an attaching hole disposed in a surface of an attaching portion of the apparatus main unit, to be movable in a direction along the surface.

6. The apparatus according to claim 2, wherein the fixing member is allowed by a gap formed between an outer circumference of the switching member fixed to the fixing member, and an attaching hole disposed in a surface of an attaching portion of the apparatus main unit, to be movable in a direction along the surface.

7. The apparatus according to claim 3, wherein the fixing member is allowed by a gap formed between an outer circumference of the switching member fixed to the fixing member, and an attaching hole disposed in a surface of an attaching portion of the apparatus main unit, to be movable in a direction along the surface.

8. The apparatus according to claim 4, wherein the fixing member is allowed by a gap formed between an outer circumference of the switching member fixed to the fixing member, and an attaching hole disposed in a surface of an attaching portion of the apparatus main unit, to be movable in a direction along the surface.

9. The apparatus according to claim 1, wherein the positioning member is configured by a positioning projection which is disposed on a lower face of the opening/closing member, and a positioning hole which is disposed in an upper face of the fixing member.

10. The apparatus according to claim 2, wherein the positioning member is configured by a positioning projection which is disposed on a lower face of the opening/closing member, and a positioning hole which is disposed in an upper face of the fixing member.

11. The apparatus according to claim 3, wherein the positioning member is configured by a positioning projection which is disposed on a lower face of the opening/closing member, and a positioning hole which is disposed in an upper face of the fixing member.

12. The apparatus according to claim 4, wherein the positioning member is configured by a positioning projection which is disposed on a lower face of the opening/closing member, and a positioning hole which is disposed in an upper face of the fixing member.

13. The apparatus according to claim 5, wherein the positioning member is configured by a positioning projection which is disposed on a lower face of the opening/closing member, and a positioning hole which is disposed in an upper face of the fixing member.

14. The apparatus according to claim 6, wherein the positioning member is configured by a positioning projection which is disposed on a lower face of the opening/closing member, and a positioning hole which is disposed in an upper face of the fixing member.

15. The apparatus according to claim 7, wherein the positioning member is configured b a positioning projection which is disposed on a lower face of the opening/closing member, and a positioning hole which is disposed in an upper face of the fixing member.

16. The apparatus according to claim 8, wherein the positioning member is configured by a positioning projection which is disposed on a lower face of the opening/closing member, and a positioning hole which is disposed in an upper face of the fixing member.

* * * * *